US006237610B1

(12) United States Patent
Trevisan

(10) Patent No.: US 6,237,610 B1
(45) Date of Patent: May 29, 2001

(54) STRUCTURE OF VARIABLY ASSEMBLED HAIR BANDS

(75) Inventor: Lisbeth Trevisan, West Caldwell, NJ (US)

(73) Assignee: Designs By Skaffles, Inc., New York, NY (US)

( * ) Notice: Subject to any disclaimer, the term of this patent is extended or adjusted under 35 U.S.C. 154(b) by 0 days.

(21) Appl. No.: 09/504,694

(22) Filed: Feb. 16, 2000

(51) Int. Cl.[7] ..... A45D 8/04; A45D 8/12
(52) U.S. Cl. ..... 132/273; 132/275
(58) Field of Search ..... 132/273, 275, 132/276, 278, 279; 2/182.1, 182.2, 182.6, 171, 174, DIG. 11, 181, 182.3

(56) References Cited

U.S. PATENT DOCUMENTS 1,539,706 * 5/1925 Wallman ..... 132/273
2,407,393 * 9/1946 Behr ..... 132/275
2,805,673 * 9/1957 Solomon ..... 132/275
3,211,160 * 10/1965 Miller ..... 132/275
5,572,746 * 11/1996 Linico ..... 2/182.1
5,822,798 * 10/1998 Baxley ..... 2/182.6
5,829,457 * 11/1998 Huang ..... 132/275
5,937,872 * 8/1999 Wang ..... 132/273

FOREIGN PATENT DOCUMENTS 340322 9/1998 (TW) .

* cited by examiner

*Primary Examiner*—Ralph A. Lewis
*Assistant Examiner*—Robyn Kieu Doan
(74) *Attorney, Agent, or Firm*—Michael R. Gilman; Kaplan & Gilman LLP

(57) ABSTRACT

This invention relates to a structure of variably assembled hair bands, more specifically, to hair bands with pins and matching holes for assembling hair bands of various patterns and colors to form various combined hair bands. A plurality of pins and corresponding holes are provided at opposite end portions on two sides of adjacent hair bands, so that the pair of the adjacent hair bands may be assembled to form an integrated hair band by matching the pins and the holes. With this design, several hair bands with different patterns or colors can be assembled together to form an integrated hair band according to personal taste, and can also be used separately as single bands. A demand on both variations and low cost is achieved.

3 Claims, 4 Drawing Sheets

STRUCTURE OF VARIABLY ASSEMBLED HAIR BANDS

TECHNICAL FIELD

This invention relates to a structure of variably assembled hair bands, more specifically, to hair bands with pins and matching holes for assembling hair bands of various patterns or colors to form various combined hair bands.

BACKGROUND OF THE INVENTION

Conventional hair bands are provided on their outer surface with different patterns in decoration or color. However, the pattern is unchangeable to a specific hair band. Hair bands of different patterns are needed by female customers to match with different clothes. To do so, they have to buy several bands different in color or decoration. Each of the bands can only be used separately and therefore the cost is high. Furthermore, young girls require more variations of hair bands. Therefore, hair bands that not only can be used separately, but also can be combined together to form bands of different patterns are highly demanded.

SUMMARY OF THE INVENTION

The main object of the invention is to provide a set of hair bands that can be assembled together by means of a plurality of matching pins and holes located at proper positions, so that the pattern of the hair band can be changed.

BRIEF DESCRIPTION OF THE DRAWINGS

For the Examiner to further understand the features and advantages of the invention, the invention is described in detail below with reference to the accompanying drawings.

DETAILED DESCRIPTION OF THE PREFERRED EMBODIMENT

Figure 1:
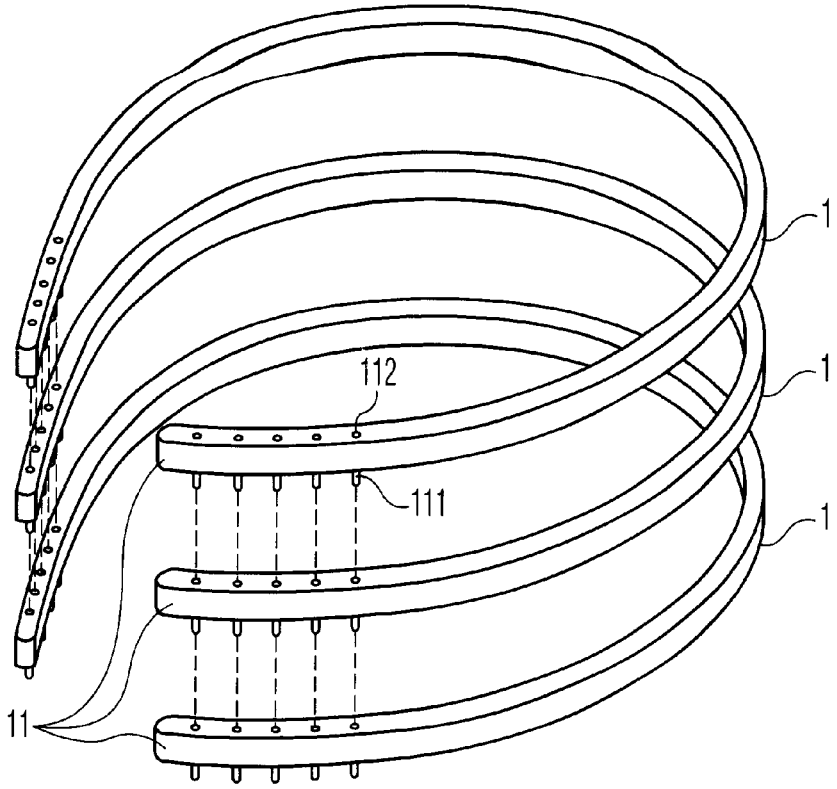
FIG. 1 is a disassembled perspective view of the invention.
Figure 2:
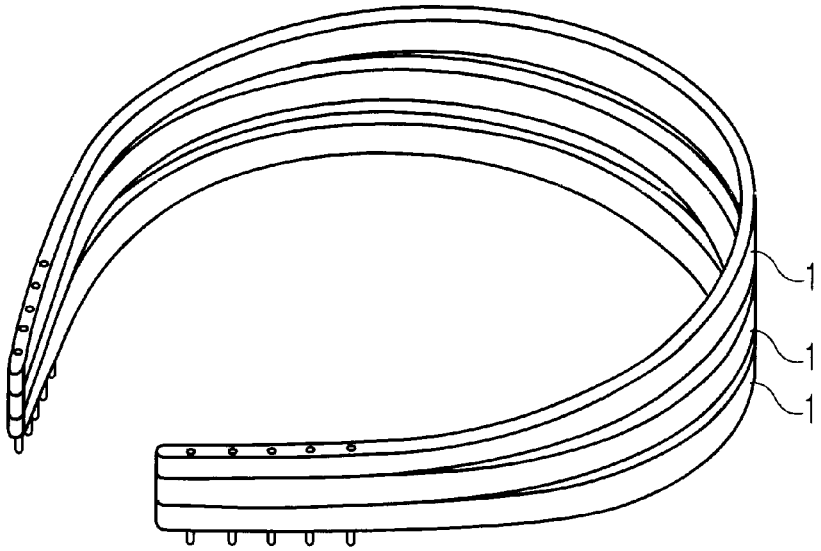
FIG. 2 is an assembled perspective view of an embodiment of the invention.
Figure 3:
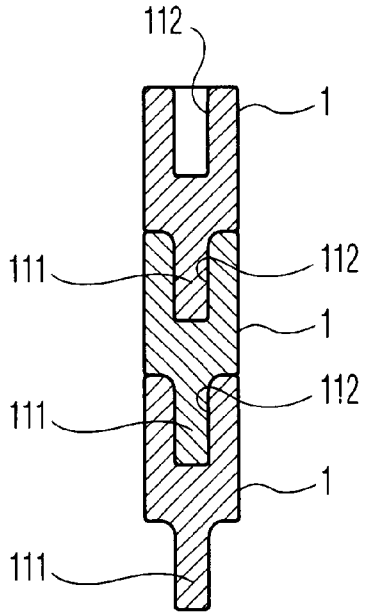
FIG. 3 is a sectional view in which the pins are inserted in the holes.
Figure 4:
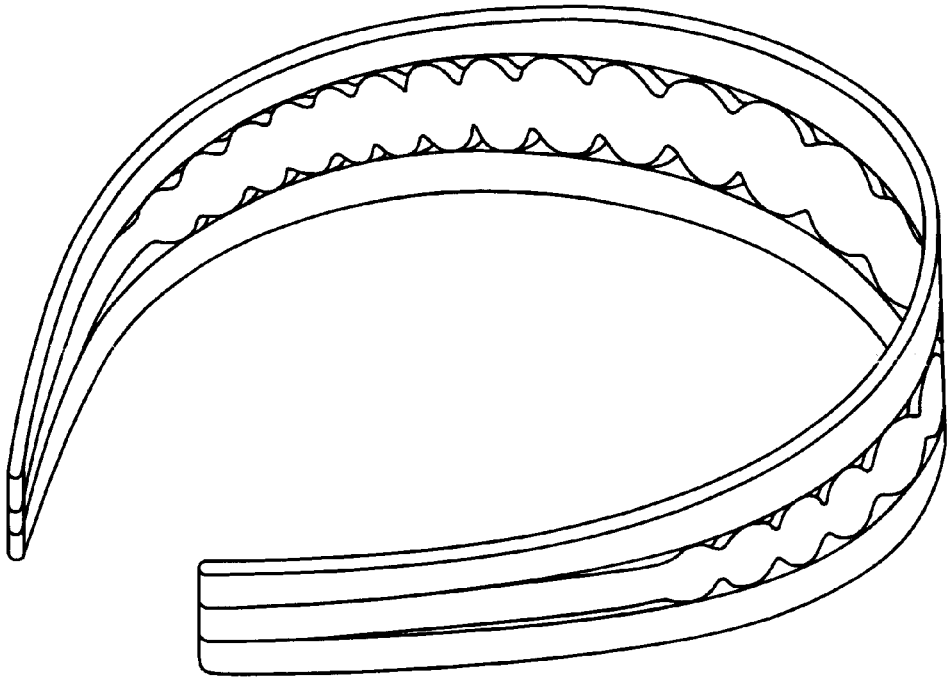
FIG. 4 shows a preferred embodiment in which several bands with different patterns are assembled together.

Firstly, as shown in FIGS. 1–3, the invention relates to a structure of variably assembled hair bands. In particular, a plurality of pins 111 and corresponding holes 112 are provided at the opposite end portions 11, on the upper and bottom sides of the bands, so that two adjacent hair bands can be assembled as an integrated one by matching of the pins 111 and holes 112. With this design, several hair bands with different patterns or colors may be assembled together according to personal taste as shown in FIG. 4. These hair bands can also be used separately as single ones. Demands on both variations and low cost is achieved. In addition, at the joint portions of the adjacent couple of the hair bands, a slope may be formed at the opposite end portions 11 so that the gap between the front ends of the hair bands may be properly opened when they are assembled together.

Figure 5:
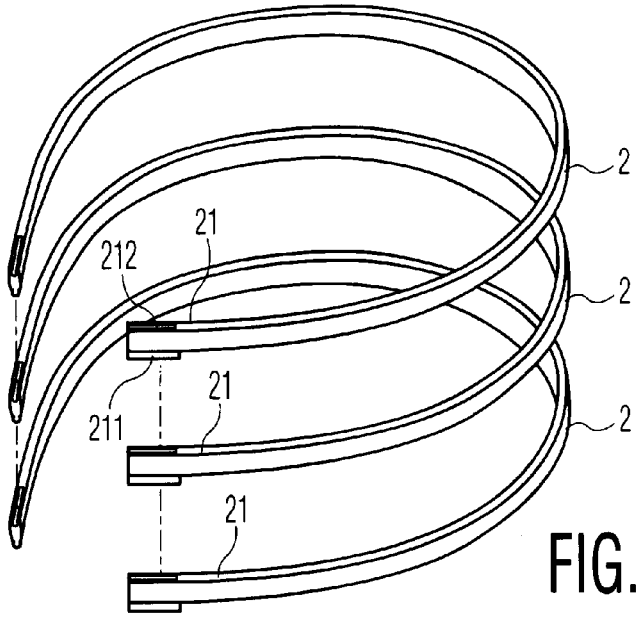
FIG. 5 is a disassembled perspective view of a second embodiment of the invention.
Figure 6:
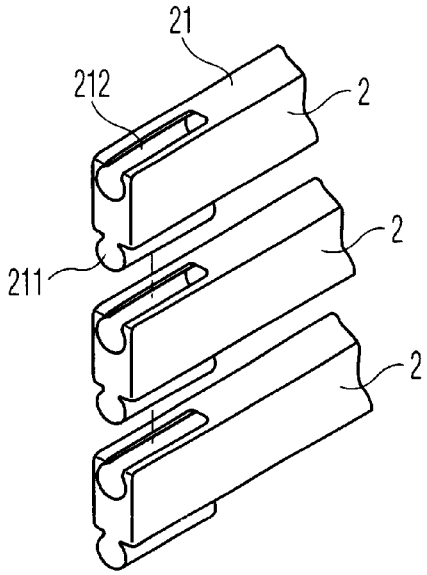
FIG. 6 is a partial perspective view showing the second embodiment in detail.
Figure 7:
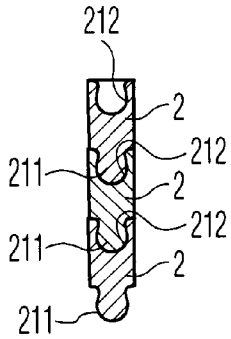
FIG. 7 is a sectional view of the second embodiment when assembled.

As shown in FIGS. 5–7 in which a second embodiment of the invention is shown. A plurality of projection bars 211 and troughs 212 are provided at the opposite end portions 21 on the two sides of the adjacent hair bands 2, so that a pair of adjacent hair bands may be assembled together to form an integrated structure by matching protection bars 211 and troughs 212. With this design, several hair bands with different patterns or colors may be assembled together according to personal taste. These hair bands can also be used separately as single hair bands. A demand on both variations and low cost is achieved.

Figure 8:
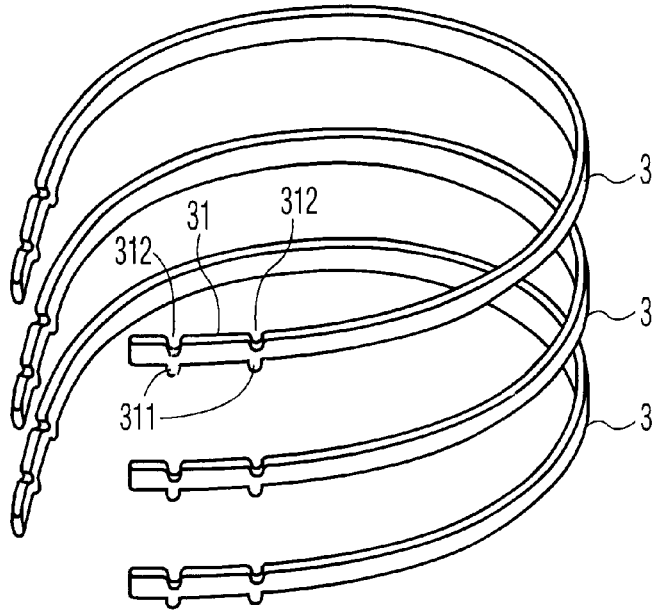
FIG. 8 is a disassembled perspective view of a third embodiment of the invention.
Figure 9:
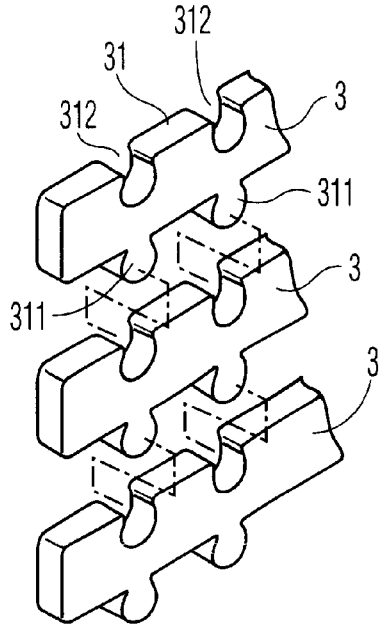
FIG. 9 is a partial perspective view showing the third embodiment in detail.
Figure 10:
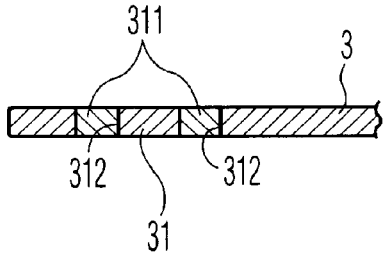
FIG. 10 is a sectional view of the third embodiment when assembled.

Finally, as shown in FIGS. 8–10 in which a third embodiment of the invention is shown. A plurality of projection studs 311 and recesses 312 are provided at the opposite end portions 21 on the two sides of the adjacent hair bands 3, so that a pair of adjacent hair bands may be assembled together to form an integrated structure by matching projection bars 311 and 312. With this design, several hair bands with different patterns or colors may be assembled together according to personal taste. These hair bands can also be used separately as single ones. A demand on both variations and low cost is achieved.

In summation, the invention may be used separately or be assembled as a combined hair band to form hair bands different in color or pattern. It has met the requirements of novelty, progressiveness and industrial utility for a patent. According to patent law, this application is now filed for acquiring patent protection.

What is claimed:

1. A hair band assembly comprising a first hair band, comprising:

inner and outer substantially longitudinally running surfaces, and a pair of oppositely opposed first and second edge surfaces, said first and second edge surfaces running between and connecting said inner and outer substantially longitudinally running surfaces;

two sets of at least one protruding member, wherein said two sets of at least one protruding member, protrude from said first edge surface; and two sets of at least one opening for receiving therein protruding members from a second hair band, wherein said two sets of at least one opening extend into said second edge surface and said second hair band including inner and outer substantially longitudinally running surfaces, and a pair of oppositely opposed first and second edge surfaces, said first and second edge surfaces running between and connecting said inner and outer substantially longitudinally running surfaces;

wherein said protruding members from said second hair band protrude from said first edge surface of said second hair band, in a manner similarly to that of said protruding member of said first hair band, and in a manner to be removingly, engagingly received into said openings in said second edge surface of said first hair band, so as to form an integrated hair band assembly comprising said first and second hair bands.

2. A hair band assembly as recited in claim 1, said first hair band further comprising first and second end sections located at opposite ends of said substantially longitudinally running surfaces and a middle section running longitudinally along said substantially longitudinally running surfaces and connecting said first and second end sections;

wherein one set of said two sets of at least one protruding member and one set of said two sets of said at least one opening are located at said first end section of said first hair band, and another set of said two sets of at least one protruding member and another set of said two sets of at least one opening are located at said second end section of said first hair band.

3. A hair band assembly as recited in claim 1, further comprising a plurality of additional hair bands, each comprising:

inner and outer substantially longitudinally running surfaces, and a pair of oppositely opposed first and second edge surfaces, said first and second edge surfaces running between and connecting said inner and outer substantially longitudinally running surfaces;

two sets of at least one protruding member, wherein said two sets of at least one protruding member protrude from said first edge surface of each of said additional hair bands; and two sets of at least one opening, wherein said two sets of at least one opening extend into said second edge surface of each of said additional hair bands;

wherein said two sets of at least one protruding member from each of said additional hair bands protrude, in a manner to be removingly, engagingly received into said openings in adjacently situated second edge surfaces of others of said additional hair bands, so as to form an integrated hair band assembly comprising said first hair band, said second hair band and said plurality of said additional hair bands.

* * * * *